US007659880B2

(12) United States Patent
Miyazawa

(10) Patent No.: US 7,659,880 B2
(45) Date of Patent: Feb. 9, 2010

(54) IMAGE DISPLAY DEVICE, IMAGE DISPLAY METHOD, AND PROGRAM

(75) Inventor: Yasunaga Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 563 days.

(21) Appl. No.: 11/353,939

(22) Filed: Feb. 15, 2006

(65) Prior Publication Data

US 2006/0186826 A1 Aug. 24, 2006

(30) Foreign Application Priority Data

Feb. 24, 2005 (JP) ..... 2005-048622

(51) Int. Cl.
*G09G 3/36* (2006.01)

(52) U.S. Cl. ..... 345/102; 455/574; 345/211

(58) Field of Classification Search ..... 345/63, 345/77, 102, 204, 211; 382/165
See application file for complete search history.

(56) References Cited

U.S. PATENT DOCUMENTS

| | | | | |
|---|---|---|---|---|
| 5,406,305 | A * | 4/1995 | Shimomura et al. | 345/102 |
| 6,747,708 | B2 | 6/2004 | Taniai et al. | |
| 2002/0050974 | A1 * | 5/2002 | Rai et al. | 345/102 |
| 2003/0026476 | A1 * | 2/2003 | Shiiyama | 382/165 |
| 2003/0142275 | A1 * | 7/2003 | Yoshida | 353/31 |
| 2004/0160435 | A1 * | 8/2004 | Cui et al. | 345/211 |
| 2004/0196252 | A1 * | 10/2004 | Kim | 345/102 |
| 2004/0257318 | A1 * | 12/2004 | Itoh | 345/87 |
| 2005/0057485 | A1 * | 3/2005 | Diefenbaugh | 345/102 |
| 2006/0022993 | A1 * | 2/2006 | Hammond | 345/590 |

FOREIGN PATENT DOCUMENTS

| | | |
|---|---|---|
| JP | A-11-041489 | 2/1999 |
| JP | A 2001-174919 | 6/2001 |
| JP | A 2001-175216 | 6/2001 |
| JP | A-2001-346219 | 12/2001 |
| JP | A-2003-348488 | 12/2003 |
| JP | A 2004-157373 | 6/2004 |
| JP | A-2004-177547 | 6/2004 |

* cited by examiner

*Primary Examiner*—Amare Mengistu
*Assistant Examiner*—Premal Patel
(74) *Attorney, Agent, or Firm*—Oliff & Berridge, PLC

(57) ABSTRACT

An image display device includes a total luminance value detection portion that detects a total luminance value in an entire image; a level detection portion that detects whether the total luminance value exceeds a specific level; and an incident light level lowering processing portion that performs processing to reduce an illumination light quantity from a light source that goes incident on a light modulation element in accordance with a function of the total luminance value when the level detection portion detects that the total luminance value exceeds the specific level.

6 Claims, 10 Drawing Sheets

IMAGE DISPLAY DEVICE, IMAGE DISPLAY METHOD, AND PROGRAM

BACKGROUND

1. Technical Field

The present invention relates to an image display device, an image display method, and a program.

2. Related Art

As the multimedia becomes more advanced, a display device has been developed to achieve a higher definition and a larger screen in recent years. For example, large-scaled direct-view liquid crystal display device, rear projection display device, and high-luminance image display device with a screen measuring 40 inches or more diagonally have been developed.

In order to improve the dynamic range and a contrast ratio of such a large-scaled image display device, an output of the backlight or lamp light source is increased, and the luminance is consequently increased further. Such an image display device, however, displays all the images while maintaining the output of the backlight or lamp light source to be constant. Hence, when used for a long period, such a large-scaled, high-luminance image display device raises a problem that elements, for example, a light valve, undergoes a color change or shortens its life due to overheating.

Meanwhile, there is an image display device in the related art that has a structure for controlling a light quantity from the backlight or lamp light source as described in the following paragraphs.

For example, JP-A-2004-157373 (page 5, FIG. 21) discloses an image display device that achieves an image display easy to see for the user through the display luminance modulation in addition to the improvements in image quality by preventing motion blurring by controlling the intermittent driving of the backlight light source or the black writing driving of the liquid crystal display panel in response to the illuminance of outside lights.

Also, JP-A-2001-175216 (page 1, FIG. 10) discloses an image display device comprising a display device using liquid crystals that achieves not only satisfactory grayscale reproducibility and color reproducibility, but also a grayscale display that remains stable over time and unsusceptible to a change in temperature.

Further, JP-A-2001-174919 (page 4, FIG. 1) discloses a projection-type image display device that can be readily reduced in overall size while being able to form a high-contrast, sharp projection image with ease in obtaining a satisfactory view image.

In each of the foregoing image display devices in the related art, however, the light control is performed to increase a contrast in a scene in which an entire image is dark. Hence, the contrast is increased by reducing an illumination light quantity to the light modulation element for such an image or a light quantity is adjusted in response to the environment lights in the surrounding. That is to say, the light source is subjected to the PWM (Pulse Width Modulation) to suppress motion blurring, which is the characteristic of the liquid crystal element. This raises a problem that the light control is not performed by taking the life of the elements forming the optical system into consideration.

SUMMARY

An advantage of some aspects of the invention is to provide an image display device, an image display method, and a program, each of which is capable of extending the life of the light modulation element.

According to a first aspect of the invention, an image display device includes: a total luminance value detection portion that detects a total luminance value in an entire image (including a still image and a moving image); a level detection portion that detects whether the total luminance value exceeds a first specific level; and an incident light level lowering processing portion that performs processing to reduce an illumination light quantity from a light source that goes incident on a light modulation element in accordance with a function of the total luminance value when the level detection portion detects that the total luminance value exceeds the first specific level.

When configured in this manner, because a light quantity from the light source is reduced in accordance with a function of the total luminance value in an entirely bright scene, heat generation of the image display device can be suppressed. It is thus possible to extend the life of the respective elements.

It is preferable that the level detection portion is enabled to detect whether the total luminance value falls below a second specific level, and that the incident light level lowering processing portion performs processing to reduce the illumination light quantity from the light source when the level detection portion detects that the total luminance value falls below the second specific level.

When configured in this manner, because an illumination light quantity is also reduced in a dark scene, heat generation of the image display image can be suppressed. It is thus possible to extend the life of the respective elements further. Also, in general, when an illumination light quantity is reduced in a dark scene, a change in light quantity is so large when a bright scene with a large light quantity is switched to a dark scene that the image becomes hard to see. However, because a light quantity is also reduced to some extent in a bright scene, a difference of light quantities can be lessened. This configuration can therefore make the image easier to see.

It is preferable that the total luminance value detection portion detects the total luminance value from a sum of luminance values of all pixels within an entire display screen.

When configured in this manner, because the total luminance value is found from a sum of the luminance values of all the pixels in the entire display screen, an objective light quantity can be detected precisely.

It is preferable that the image display device further includes an illumination light quantity adjudging device that adjusts the illumination light quantity from the light source.

When configured in this manner, a light quantity to the light modulation element is adjusted by controlling the illumination light quantity adjusting device while maintaining the light quantity from the light source per se to be constant. It is thus possible to adjust a light quantity of illumination lights effectively using a light source for which it is difficult to change a light quantity at high speeds.

According to a second aspect of the invention, an image display device includes: a total luminance value detection portion that detects a total luminance value of an entire image from a direct current component (DC component) in encoded display information; a level detection portion that detects whether the total luminance value exceeds a specific level;

and an incident light level lowering processing portion that performs processing to reduce an illumination light quantity that goes incident on a light modulation element in accordance with a function of the total luminance value when the level detection portion detects that the total luminance value exceeds the specific level.

When configured in this manner, in a case where the display information is encoded display information, such as MPEG (Motion Pictures Expert Group) or JPEG (Joint Photographic Expert Group) data, the total luminance value of the entire image is detected from the direct current component in the encoded display information. The total luminance value can be therefore found more rapidly.

According to a third aspect of the invention, an image display method includes: detecting a total luminance value of an entire image; detecting whether the total luminance value exceeds a specific level; and reducing an illumination light quantity from a light source by performing light control in accordance with a function of the total luminance value when it is detected that the total luminance value exceeds the specific level.

Because this method is a method performed using the image display devices described above, the same advantages as the image display devices according to the first and second aspects of the invention can be achieved.

According to a fourth aspect of the invention, an image display method of the invention includes: detecting a total luminance value of an entire image from a direct current component (DC component) in encoded display information; detecting whether the total luminance value exceeds a specific level; and reducing an illumination light quantity from a light source by performing light control in accordance with a function of the total luminance value when it is detected that the total luminance value exceeds the specific level.

Because this method is also a method performed using the image display devices described above, the same advantages as the image display devices according to the first and second aspects of the invention can be achieved.

According to a fifth aspect of the invention, a program causes a computer inside an image display device to function as: a total luminance value detection portion that detects a total luminance value in an entire image; a level detection portion that detects whether the total luminance value exceeds a specific level; and an incident light level lowering processing portion that performs processing to reduce an illumination light quantity from a light source that goes incident on a light modulation element in accordance with a function of the total luminance value when the level detection portion detects that the total luminance value exceeds the specific level.

By running the program of the invention on the computer inside the image display devices described above, the same advantages as those of the image display devices according to the first and second aspects of the invention can be achieved.

The invention as has been described above can be applied to an image display device for use in a presentation and the home theater.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of the invention will be described with reference to the drawings.

Figure 1:
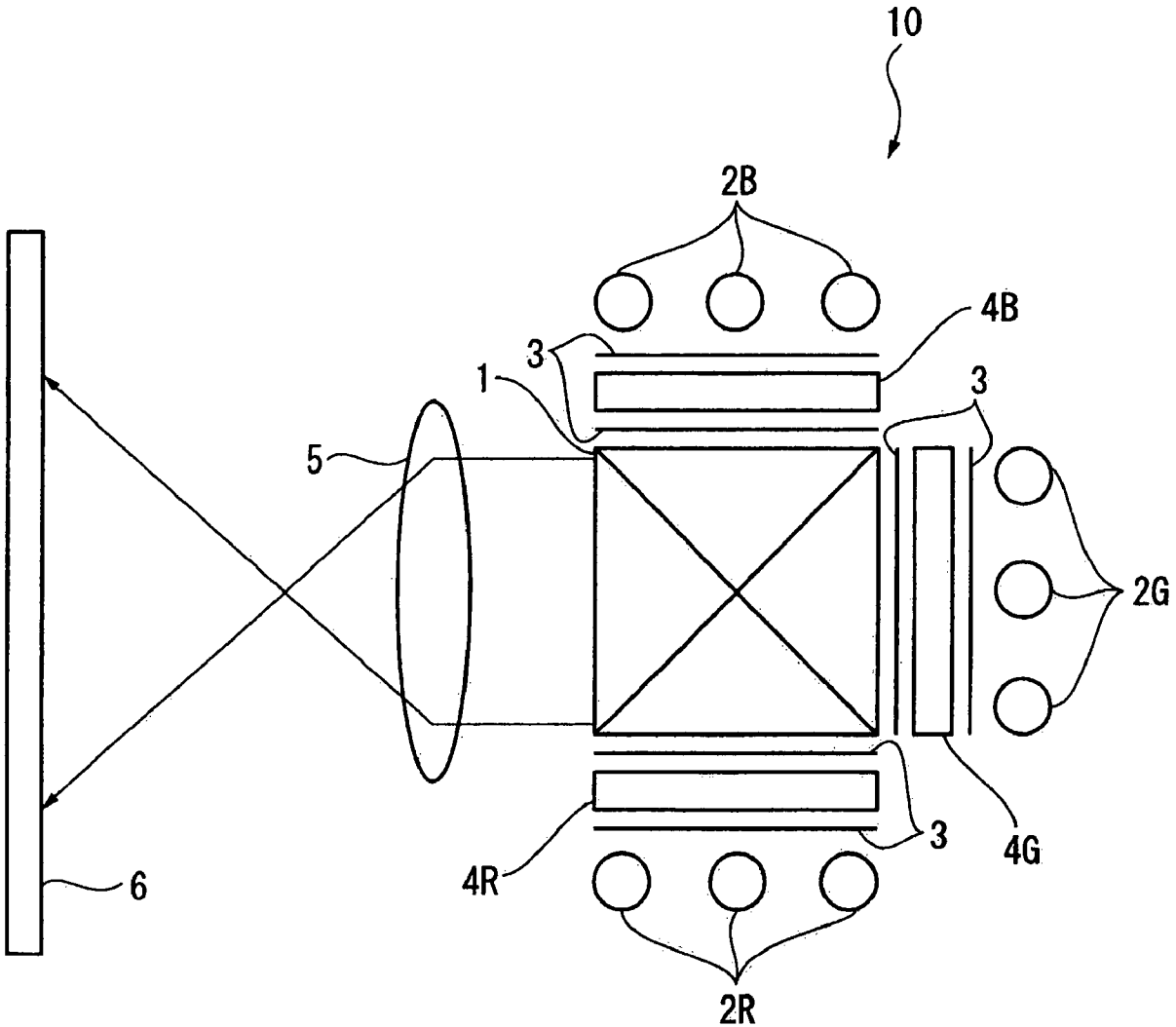
FIG. 1 is a plan view showing an optical system in an image display device according to a first embodiment of the invention.
Figure 2:
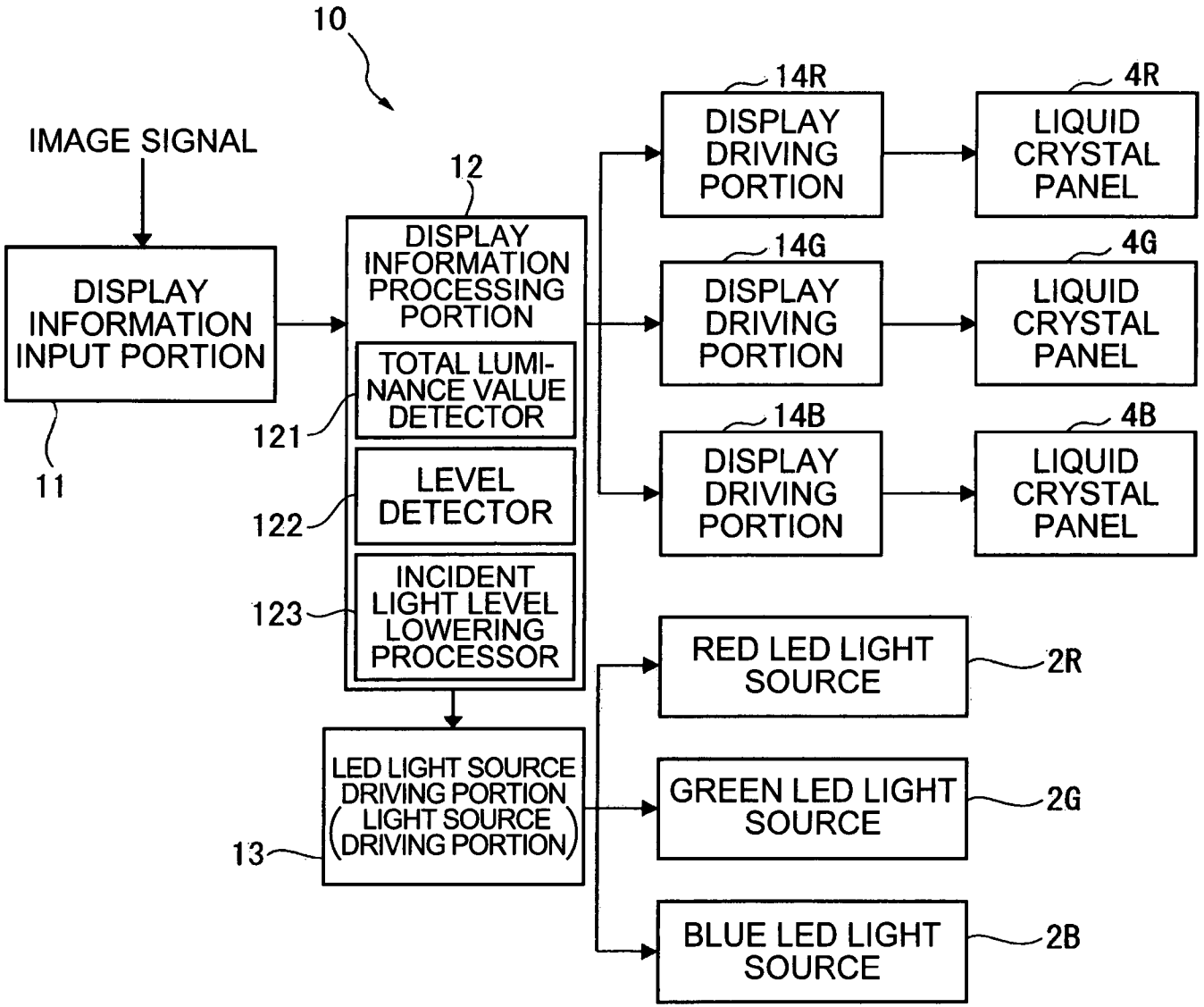
FIG. 2 is a block diagram showing the image display device of the first embodiment.
Figure 3:
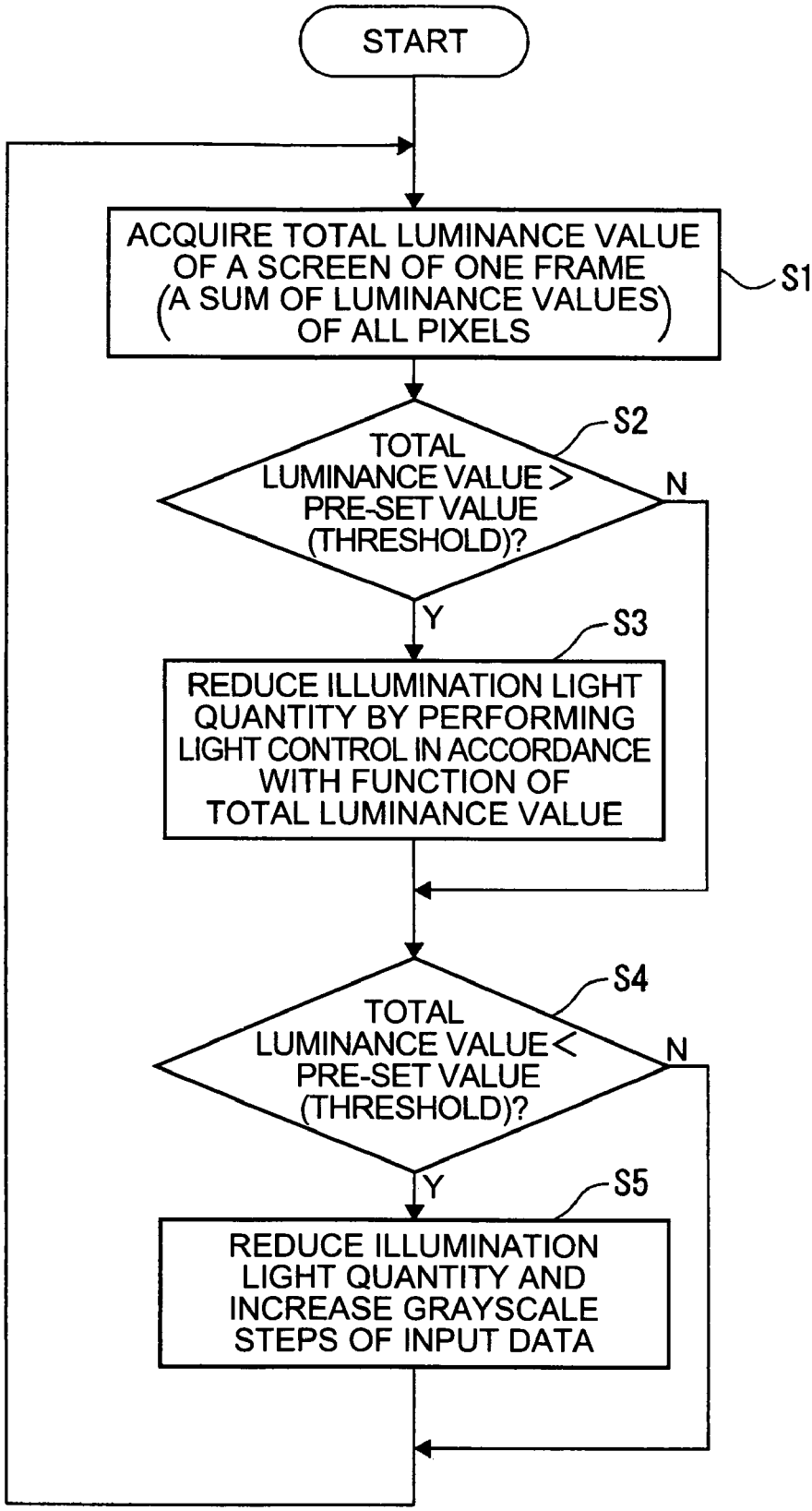
FIG. 3 is a flowchart detailing operations of the image display device of the first embodiment.

FIG. 1 through FIG. 3 show a projection-type image display device 10 according to the first embodiment. FIG. 1 is a plan view of an optical system in the image display device 10 when a liquid crystal light valve is used as a light modulation element, and solid-state light sources (LED (Light Emitting Diode) light sources) of respective colors, RGB, are used as the light source. FIG. 2 is a block diagram of the image display device 10. FIG. 3 is a flowchart detailing operations of the image display device 10.

Configuration of Optical System in Image Display Device

Referring to FIG. 1, the optical system in the image display device 10 of the first embodiment comprises a dichroic prism 1, a red LED light source 2R, a green LED light source 2G, a blue LED light source 2B, deflection plates 3, a liquid crystal panel 4R, a liquid crystal panel 4G, a liquid crystal panel 4B, and a projection lens 5. Liquid crystal light valves are formed by attaching the deflection plates 3 to the respective liquid crystal panels 4R, 4G, and 4B.

A light emitted from the red LED light source 2R goes incident on the dichroic prism 1 via the deflection plates 3 and the transmissive liquid crystal panel 4R. A light emitted from the green LED light source 2G goes incident on the dichroic prism 1 via the deflection plates 3 and the transmissive liquid crystal panel 4G. A light emitted from the blue LED light source 2B goes incident on the dichroic prism 1 via the deflection plates 3 and the transmissive liquid crystal panel 4B. Each of the liquid crystal panel 4R, the liquid crystal panel 4G, and the liquid crystal panel 4B forms an optical image representing a change of a polarization state according to a video signal.

The dichroic prism 1 is formed by laminating four triangular prisms, and a red-reflecting dichroic multi-layer film and a blue-reflecting dichroic multi-layer film are evaporated onto the inclined planes of the dichroic prism 1 that form lamination planes to cross each other in the shape of a capital X. The respective primary colors that have come incident on the dichroic prism 1 are combined into a single light by the dichroic prism 1. The combined light then goes incident on the projection lens 5, so that optical images formed on the liquid crystal panel 4R, the liquid crystal panel 4G, and the liquid crystal panel 4B are enlarged and projected onto the screen 6 by the projection lens 5.

Also, as is shown in FIG. 2, the image display device 10 of the first embodiment pre-stores a computer program that causes various kinds of hardware to function as a display information input portion 11, a display information processing portion 12, an LED light source driving portion 13, and display driving portions 14R, 14G, and 14B, as well as a total luminance value detector 121, a level detector 122, and an incident light level lowering processor 123 included in the display information processing portion 12 in addition to the LED light sources 2R, 2G, and 2B and the liquid crystal panels 4R, 4G, and 4B described above.

The display information input portion 11 is used to input display information from a PC (Personal Computer) or a DVD (Digital Versatile Disk) player. In the case of compressed digital data, the display information input portion 11 performs processing, such as decoding, and in the case of an analog signal, it performs processing, such as analog-to-digital conversion. The input display information is thus converted to an RGB image signal, which is then supplied to the display information processing portion 12.

The display information processing portion 12 is furnished with a function of determining an illumination light quantity to be irradiated to the light modulation element and transmitting an adjustment signal according to the illumination light quantity to the LED light source driving portion 13, and a function of performing color correction processing (γ processing, and irregular color corrections, etc.) on the display information and transmitting image data, in which respective colors have been corrected, to the display driving portions 14R, 14G, and 14B of the liquid crystal panels 4R, 4G, and 4B of the respective colors.

The LED light source driving portion 13 adjusts an illumination light quantity through the PWM modulation or any other adequate method by controlling the LED light sources 2R, 2G, and 2B of the respective colors according to the adjustment signal of the illumination light quantity from the display information processing portion 12. In short, the LED light source driving portion 13 controls exiting light quantities from the LED light sources 2R, 2G, and 2B per se.

The display driving portions 14R, 14G, and 14B generate driving signals according to image data from the display information processing portion 12, and drive the liquid crystal panels 4R, 4G, and 4B, respectively.

The total luminance value detector 121 in the display information processing portion 12 generates histogram data from the display information of a current frame, and detects a total luminance value of the entire screen on the basis of the histogram.

The level detector 122 detects whether the detected total luminance value exceeds a pre-set upper limit value and falls below a pre-set lower limit value.

The incident light level lowering processor 123 outputs to the LED light source driving portion 13 an adjustment signal such that reduces illuminance light quantities to the liquid crystal panels 4R, 4G, and 4B of the respective colors to be lower than the normal value (maximum value) on the basis of the detection result from the level detector 122.

Operations of Image Display Device

Operations of the image display device will now be described with reference to FIG. 3 through FIG. 8. FIG. 4A through FIG. 8 are conceptual views to adjust the luminance value of an output image.

The total luminance value detector 121 forming the display information processing portion 12 of the image display device 10 initially acquires the total luminance value (the product of the luminance value and the number of pixels) of one frame by generating histogram data (see the histogram of FIG. 4A) from the display information (luminance data contained therein) (Step S1).

Subsequently, the level detector 122 in the display information processing portion 12 judges whether the total luminance value thus acquired is larger than the threshold value UL of the upper limit (Step S2).

When the total luminance value is larger than the threshold value UL, the incident light level lowering processor 123 performs the light control in accordance with a function of the total luminance value (a decreasing function that reduces the illuminance light quantity more as the total luminance value, which is greater than the threshold value UL, becomes larger). To be more specific, as is shown in FIG. 8, the LED light source driving portion 13 reduces the illumination light quantities by controlling the LED light sources 2R, 2G, and 2B of the respective colors (Step S3).

Figure 4B:
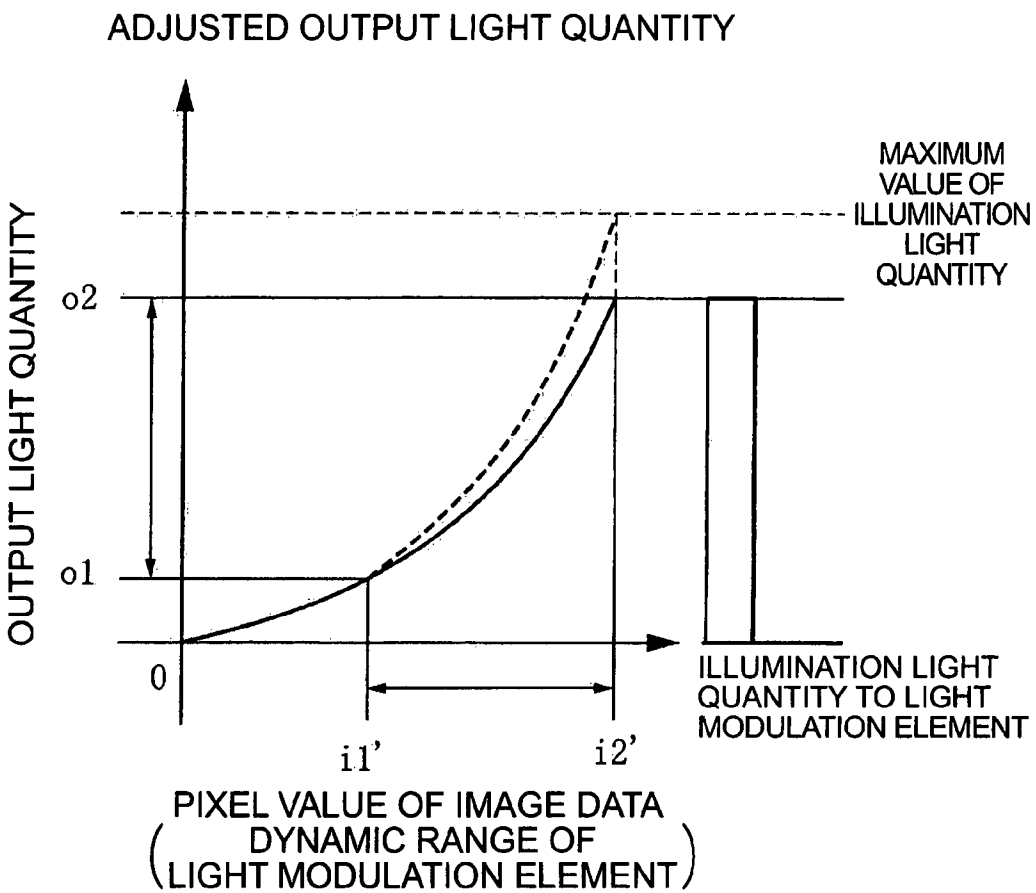
FIGS. 4A and 4B are conceptual views to adjust a luminance value of an output image.
Figure 4A:
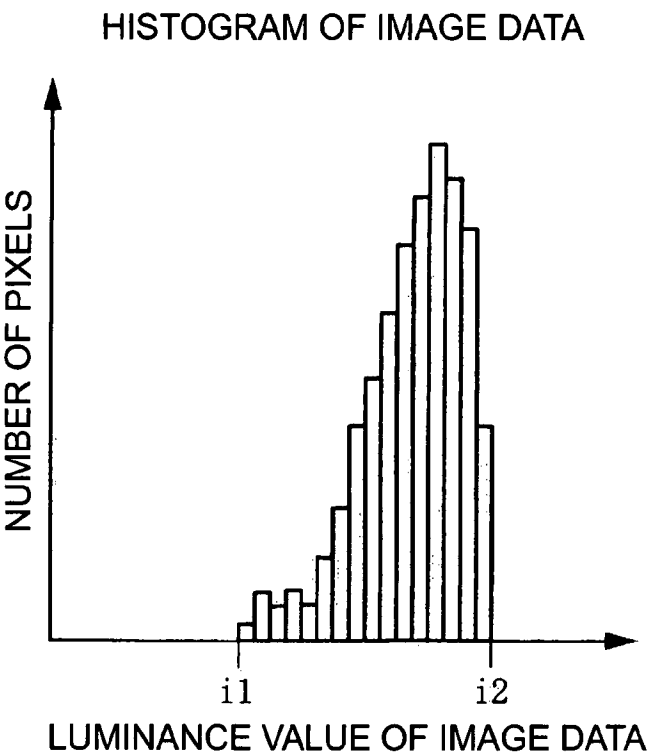

A dotted line in FIG. 4B indicates an output light quantity (output value) from a pixel in the case of the related art when the device is used at the maximum illumination light quantity, and a solid line indicates an output light quantity in the case of the first embodiment when the illumination light quantity is reduced. As is obvious from this drawing, an output light quantity outputted via a pixel is slightly smaller in the first embodiment than in the related art, and the output light quantity is not reduced to the extent of deteriorating the contrast. Also, the grayscale range (dynamic range) i1' to i2' on the pixel side (FIG. 4B) to achieve the luminance range i1 to i2 shown in FIG. 4A has the same range width, and there is no need to change the grayscale data.

Subsequently, the level detector 122 judges whether the acquired total luminance value is smaller than the threshold value LL of the lower limit (Step S4).

Figure 5A:
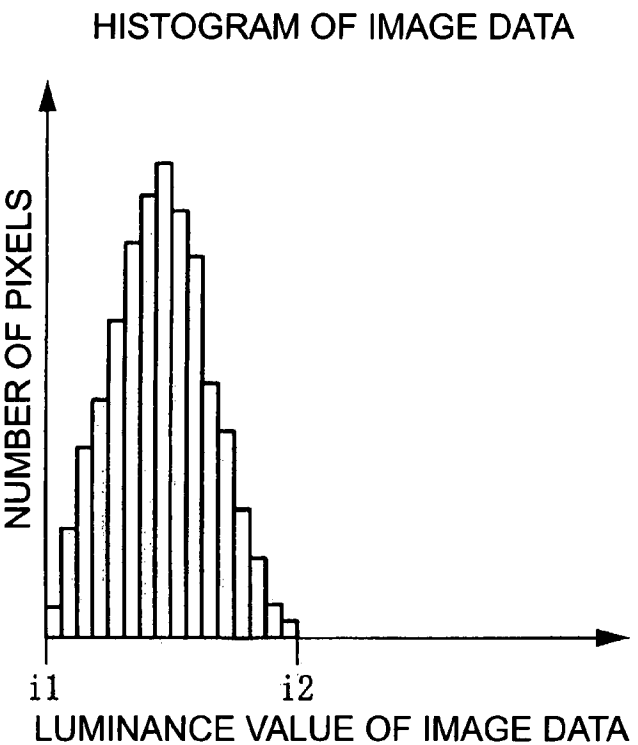
FIGS. 5A and 5B are conceptual views to adjust a luminance value of an output image.
Figure 5B:
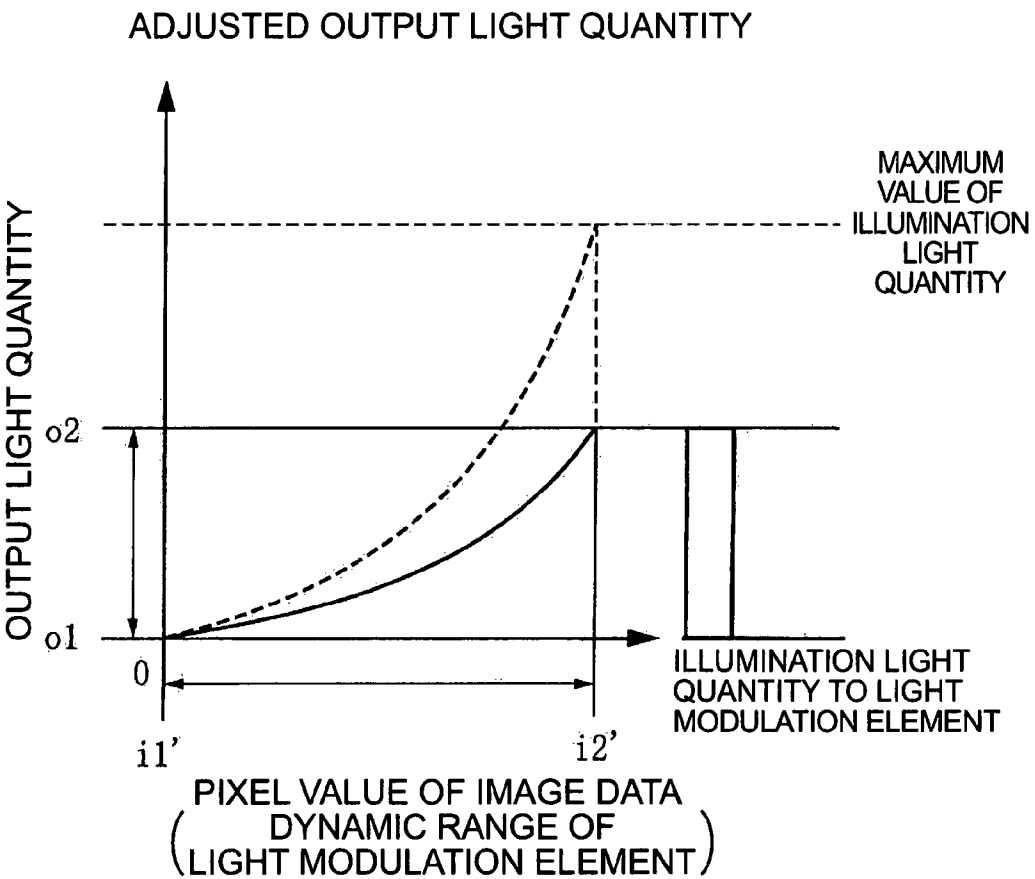
Figure 7A:
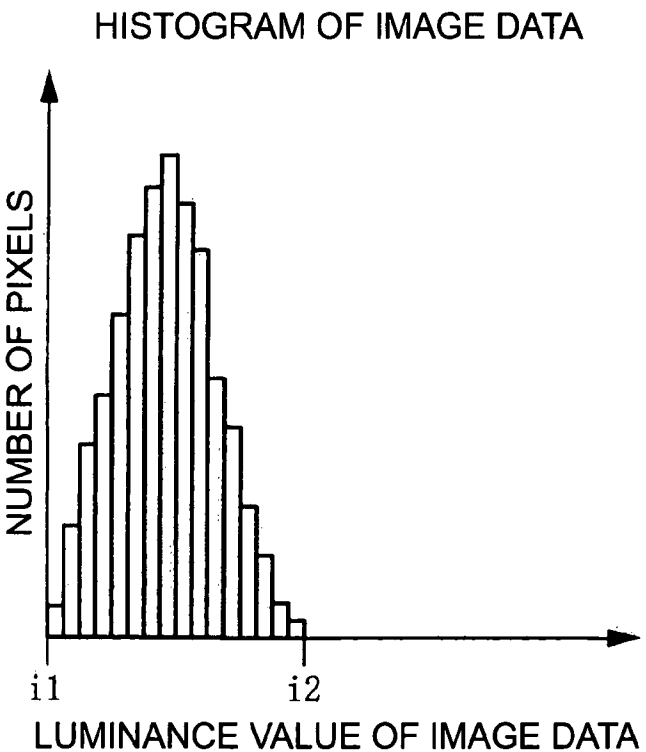
FIGS. 7A and 7B are conceptual views to adjust a luminance value of an output image.
Figure 7B:
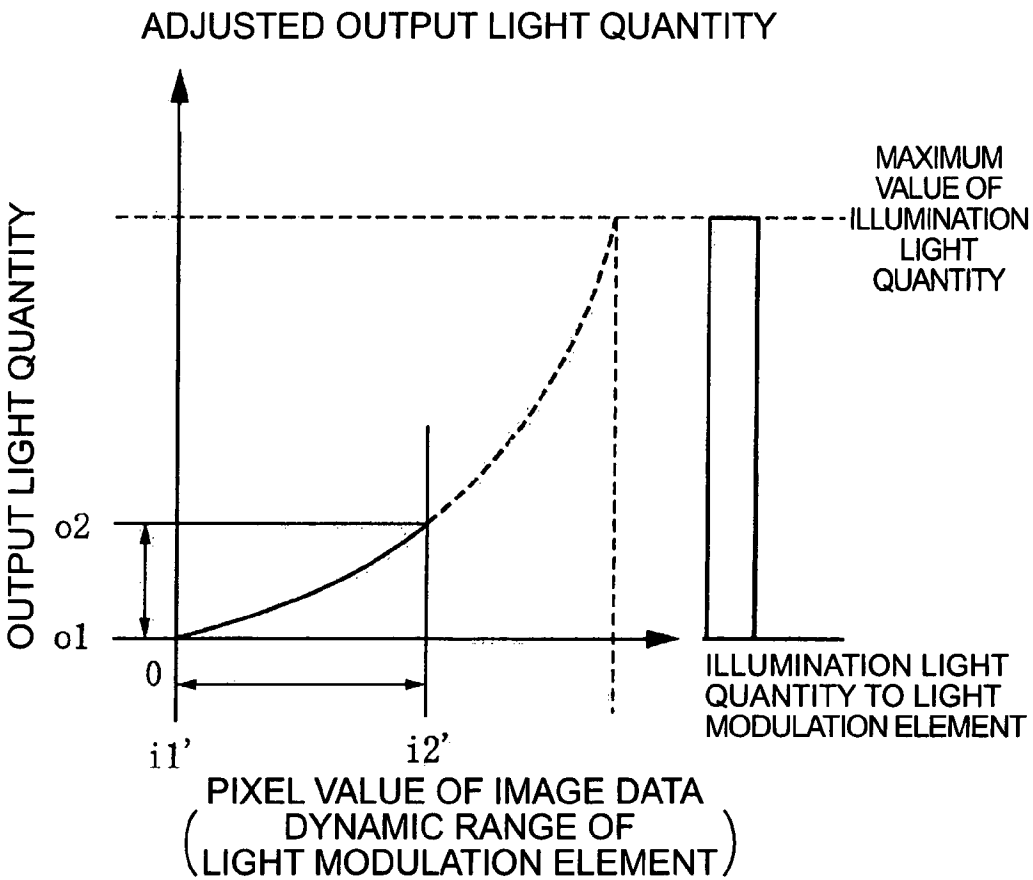
Figure 8:
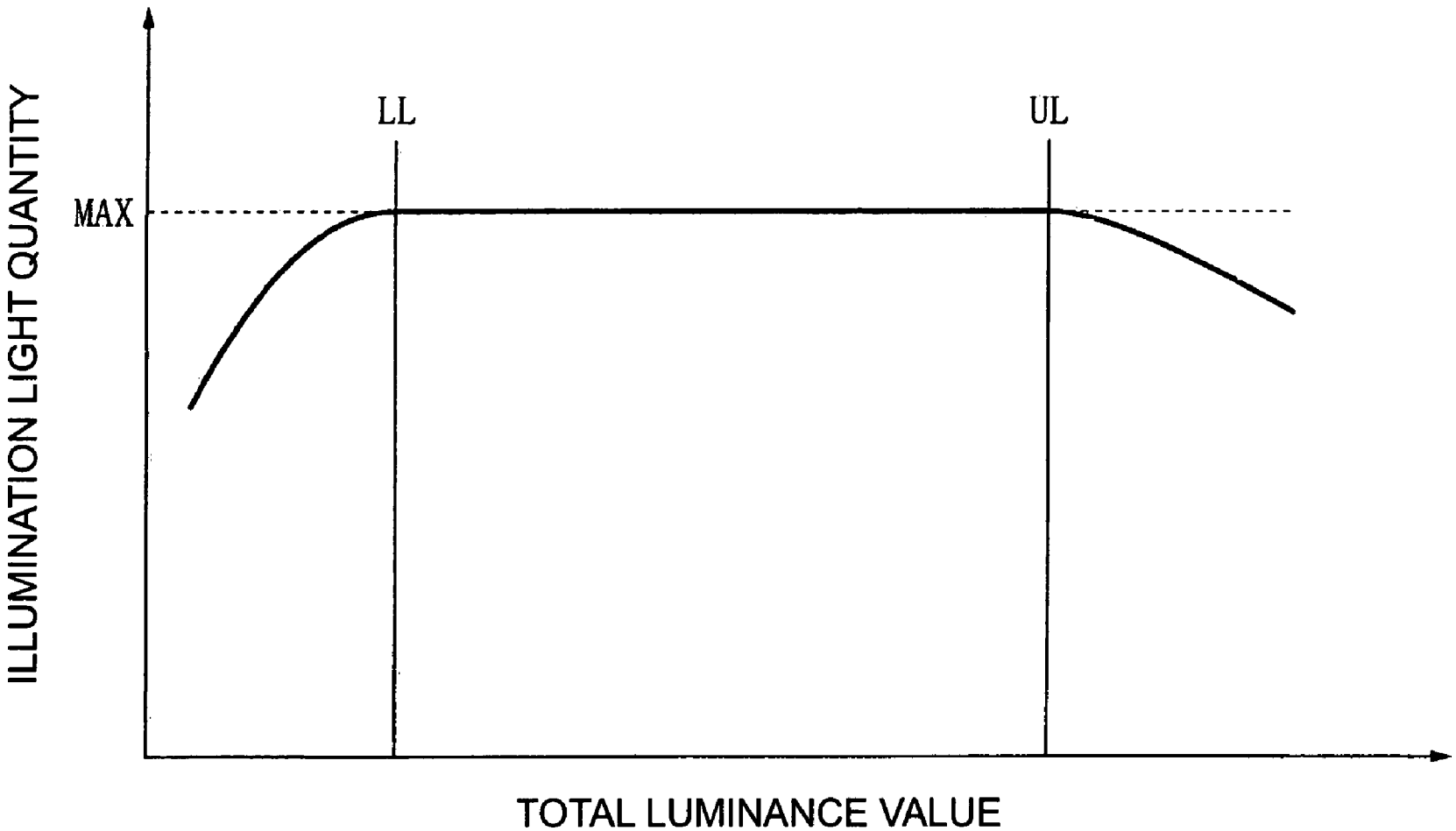
FIG. 8 is a conceptual view to adjust a luminance value of an output image.

When the total luminance value is smaller than the threshold value LL shown in FIG. 8 (when the histogram data of FIG. 5A is generated), the incident light level lowering processor 123 reduces the illumination light quantity markedly and changes the grayscale data by controlling the LED light source driving portion 13. The original grayscale range i1' to i2' shown in FIG. 7B is thus widened to the grayscale range i1' to i2' as shown in FIG. 5B, and the luminance range i1 to i2 shown in FIG. 5A is achieved with more grayscale steps (Step S5). Even when the total luminance value is small, in the case of histogram of a so-called isolated island type, that is, in a case where pixels having a high luminance value is present like an isolated island from the group of pixels having a low luminance value, it is necessary to take into account the maximum value of the luminance value (RGB value) and the luminance value (RGB value) that falls within a few % of the maximum value in addition to the total luminance value of the image data when the illuminance light quantity to the liquid crystal light valve is adjusted.

In the case of FIG. 5B, the overall darkness is expressed by reducing the illumination light quantity. However, because not only is the grayscale range widened to i1' to i2', but also the illumination light quantity is set so that the pixel having the highest luminance becomes sufficiently bright, a satisfactory contrast can be achieved. This configuration makes a dark scene easy to see. Also, in the case of FIG. 5B, because an illumination light quantity is reduced in a dark scene, a change in light quantity to the user's eyes is large when a bright scene is abruptly switched to a dark scene. However, in the first embodiment, as has been described in FIGS. 4A and 4B, because an illumination light quantity is reduced also in a bright scene, it is possible to lessen a difference of light quantities. This configuration makes the image easier to see.

Figure 6A:
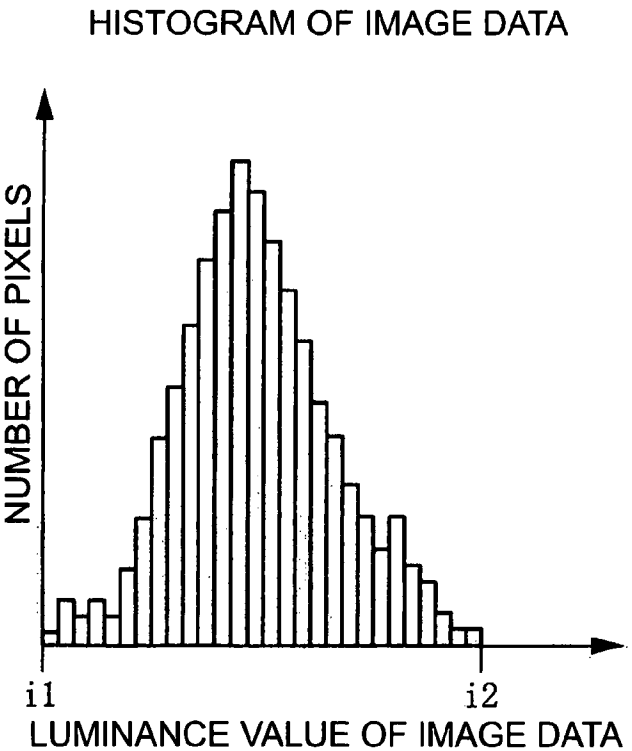
FIGS. 6A and 6B are conceptual views to adjust a luminance value of an output image.
Figure 6B:
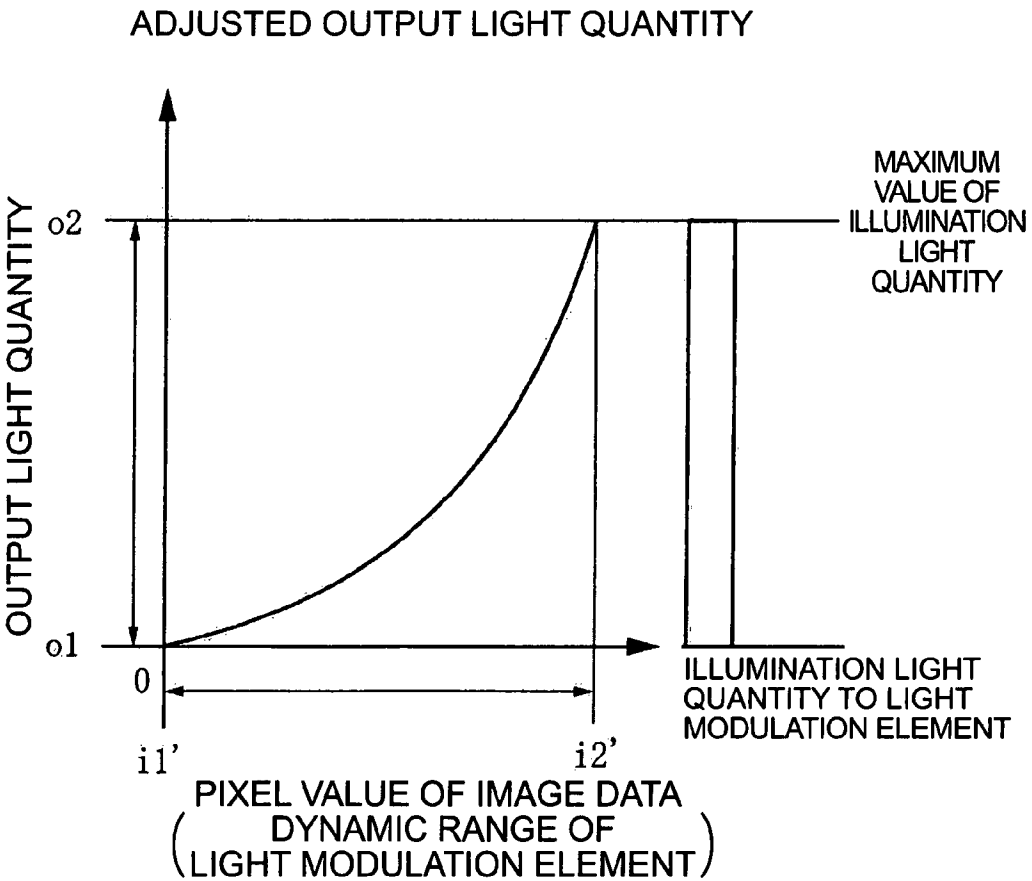

When the judgments in Step S2 and Step S5 are both negative (N), as is shown in FIG. 6B, it is judged that bright pixels and dark pixels are present evenly within one frame. Hence, as is shown in FIG. 6B, neither the illumination light quantity nor the grayscale data is changed, and the total luminance value of the following frame is acquired (Step S1).

According to the image display device 10 of the first embodiment, because an overall illumination light quantity is reduced in a scene in which an entire image is bright, heat generation of the light modulation elements can be lessened. It is thus possible to extend the life of the elements.

Moreover, because an overall illumination light quantity is also reduced in an entirely dark scene, the life of the elements can be extended further.

Also, because an overall illumination light quantity is reduced even in a scene where an entire image is dark and the grayscale steps of input data are increased, a satisfactory contrast can be achieved even in a dark scene. An easy-to-see image can be thus provided.

When an illumination light quantity is reduced in a dark scene, a change in light quantity is so large that an image becomes hard to see when a bright scene with a large light quantity is switched to a dark scene with a small light quantity. However, in the first embodiment, because a light quantity is reduced to some extent even in a bright scene, a difference of light quantities can be lessened. This configuration can therefore make the image easier to see.

Because the LED light sources 2R, 2G, and 2B are used in the first embodiment, electric energy to be supplied to the LED light sources can be reduced when the overall illumination light quantity is reduced. This configuration makes it possible to suppress heat generation of the LED light sources per se; moreover, power consumption can be reduced.

Further, because the total luminance value can be found from a sum of the luminance vales of all the pixels within the entire display screen, an objective light quantity can be detected precisely.

Second Embodiment

Figure 9:
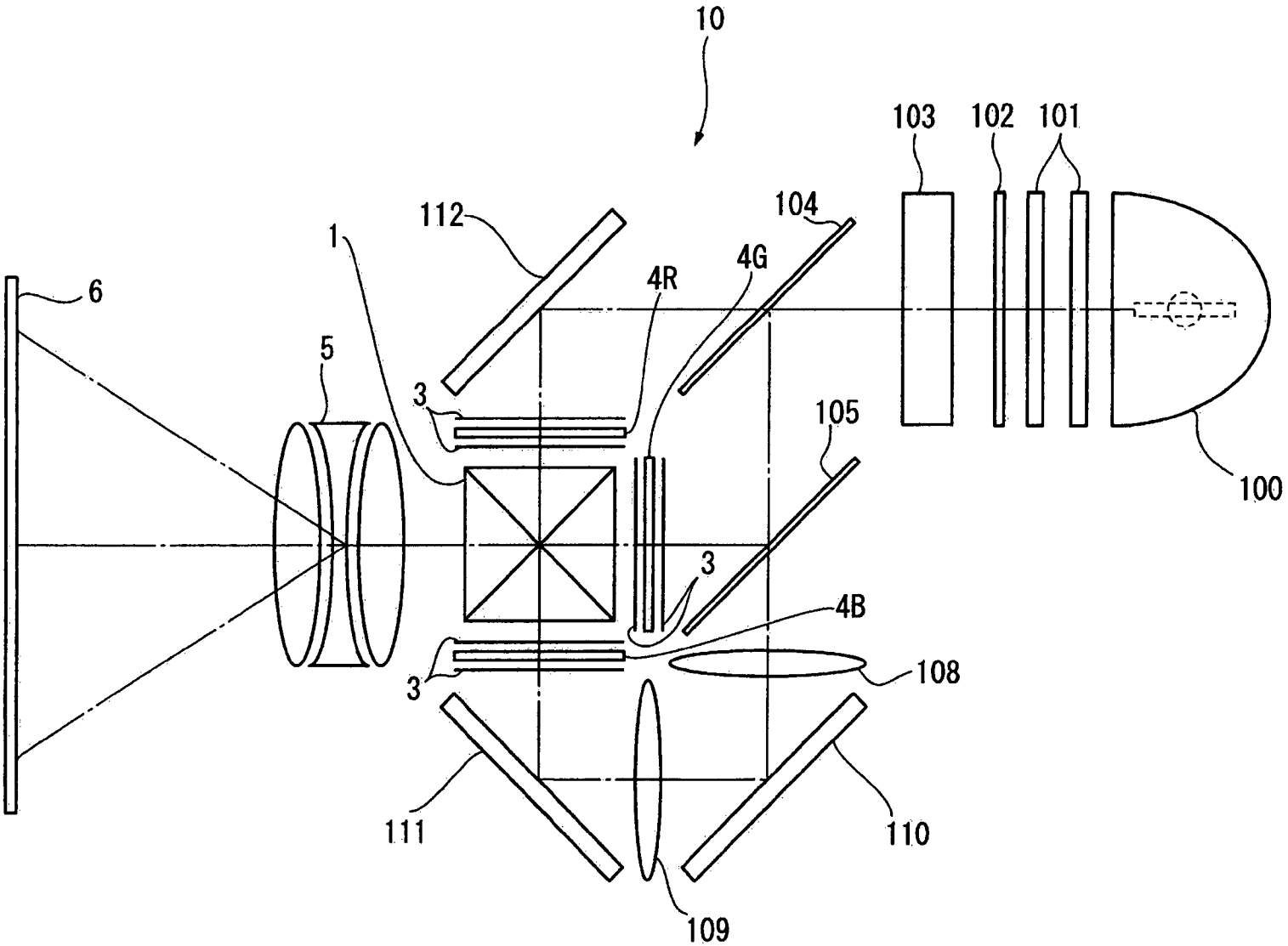
FIG. 9 is a plan view showing an optical system in an image display device according to a second embodiment of the invention.
Figure 10:
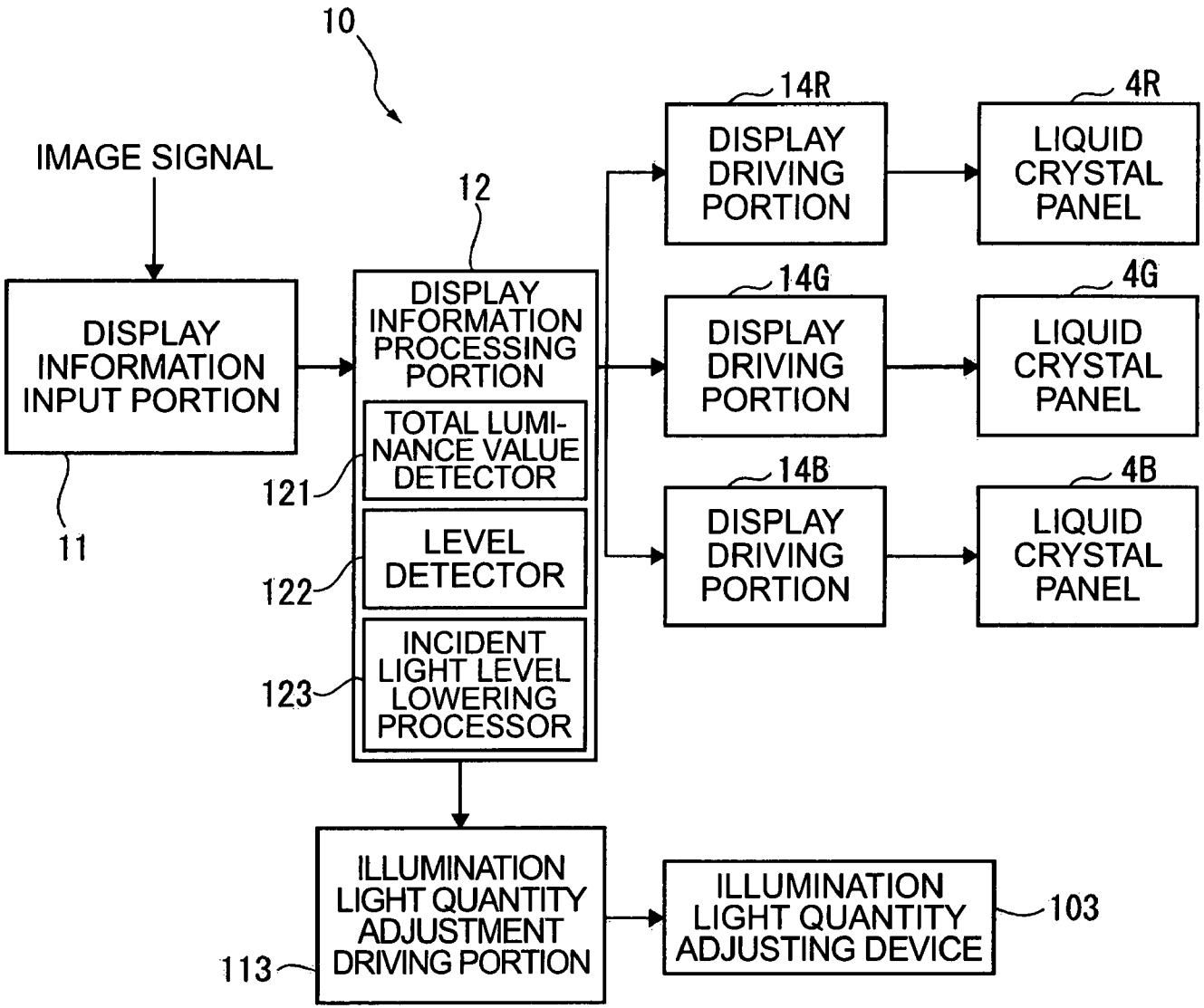
FIG. 10 is a block diagram showing the image display device of the second embodiment.

FIG. 9 and FIG. 10 show an image display device 10 according to a second embodiment of the invention.

FIG. 9 is a plan view of an optical system when a light quantity is adjusted using an illumination light quantity adjusting device 103 that electrically changes a light transmissivity. FIG. 10 is a block diagram of the image display device 10. Like components are labeled with like reference numerals with respect to the first embodiment above, and the descriptions of these components are omitted or given briefly.

Referring to FIG. 9, the optical system of the second embodiment comprises a light source 100 formed of a gaseous light-emitting light source, such as a metal halide lamp, a halogen lamp, and a high-pressure mercury vapor lamp, an integrator lens 101, a polarization conversion element 102, an illumination light quantity adjusting device 103, dichroic mirrors 104 and 105, deflection plates 3, a liquid crystal panel 4R, a liquid crystal panel 4G, a liquid crystal panel 4B, a projection lens 5, collective lens 108 and 109, reflection plates 110, 111, and 112, a projection lens 5, and a dichroic prism 1.

A light emitted from the light source 100 passes through an illumination system comprising the integrator lens 101, the polarization conversion element 102, and the illumination light quantity adjusting device 103. The light then goes incident on a color separation system comprising the red-transmitting dichroic mirror 104, the green-reflecting dichroic mirror 105, and the reflection plate 112, and is separated into lights of primary colors, red, green, and blue. A blue light goes incident on a relay system comprising the first collective lens 108, the second collective lens 109, and the two reflection plates 110 and 111. Red and green lights exiting from the color separation system and the blue light exiting from the relay system pass through the deflection plates 3, and then independently go incident on the corresponding liquid crystal panel 4R, the liquid crystal panel 4G, and the liquid crystal panel 4B. Of the optical paths from the light source 100 to the respective liquid crystal panel 4R, liquid crystal panel 4G, and liquid crystal panel 4B, the optical path for blue is longer than the optical paths for the other colors. However, because lights that the two collective lenses 108 and 109 are to scatter are converged inward, lights can be transmitted efficiently to the blue liquid crystal panel 4B even when the optical path is longer than the others.

The characteristic of the second embodiment is that, as is shown in FIG. 10, the image display device 10 includes an illumination light quantity adjustment driving portion 113 that drives the illumination light quantity adjusting device 103.

The illumination light quantity adjusting device 103 comprises, for example, a light focusing mechanism or electrochromic glass, and is disposed on the light exiting side of the light source 100.

The illumination light quantity adjustment driving portion 113 adjusts an illumination light quantity by controlling the illumination light quantity adjusting device 103 according to an adjustment signal of an illumination light quantity transmitted from the display information processing portion 12.

Operations in the second embodiment will now be described, and operations are different from those in the first embodiment in the control method of an illumination light quantity. More specifically, in the first embodiment, an illumination light quantity was controlled by adjusting light quantities of the LED light sources 2R, 2G, and 2B of the respective colors by means of the LED light source driving portion 13 according to the adjustment signal from the display information processing portion 12. Meanwhile, in the second embodiment, an illumination light quantity is controlled by controlling the illumination light quantity adjusting device 103 by means of the illumination light quantity adjustment driving portion 113 to adjust a light quantity from the light source 100 also according to the adjustment signal from the display information processing portion 12. In other words, in the second embodiment, an illumination light quantity emitted from the light source 100 per se is constant (always at the maximum), and an irradiation quantity to the light modulation elements is adjusted by shielding lights using the illumination light quantity adjusting device 103. The other operations are identical with those in the first embodiment, and descriptions of such operations are omitted herein.

In the second embodiment, because a light quantity from the light source 100 per se is not reduced, there is no advantage that power consumption is reduced as in the first embodiment. However, the second embodiment can achieve the same advantages as the first embodiment other than this advantage.

Also, in the second embodiment, because an illumination light quantity is adjusted by the illumination light quantity adjusting device 103 while the light quantity from the light source 100 is maintained to be constant, the light source 100, for which it is difficult to change a light quantity at high speeds, can be adjusted effectively.

Modifications

It should be appreciated that the invention is not limited to the embodiments above, and it is understood that modifications and improvements within the scope to achieve the advantage of the invention are included in the invention.

For example, the embodiments above described a projection-type image display device by way of example. The invention, however, is not limited to this configuration, and the invention is also applicable to a direct-view liquid crystal display device or a rear projection display device using a backlight.

The method for finding the total luminance value from a sum of products of the luminance values of all the pixels and the number of pixels was described in the embodiments above as an example of the method for finding the total luminance value. The invention, however, is not limited to this method. For example, in the case of encoded data, such as JPEG or MPEG data, a portion corresponding to the head of the DCT (Discrete Cosine Transform) coefficient, that is, the upper left cell in the quantized matrix, is equivalent to the constant term after the DCT, and thereby includes a component (referred to as the DC component) representing a mean value of the entire wave. The total luminance value may be therefore found from this particular portion, that is, the DC component (direct current component).

In the embodiments above, when the total luminance value is smaller than the threshold value LL of the lower limit (when the histogram data of FIG. 5A is generated), it is controlled in such a manner that an illumination light quantity is reduced markedly and the grayscale data is changed to widen the range to the grayscale range i1' to i2' (see FIG. 5B). However, an illumination light quantity may not be reduced and the original grayscale range i1' to i2' may be left intact (see FIG. 7B).

Also, the liquid crystal light valves were described as an example of the light modulation elements. However, the invention is not limited to this configuration, and the light modulation element can be a DMD (Digital Micro mirror Device), or an LCOS (Liquid Crystal on Silicon).

The configurations in the best mode for carrying out the invention have been disclosed in the descriptions above. The invention, however, is not limited to the descriptions above. More specifically, the invention has been illustrated and described particularly for specific embodiments. However, anyone skilled in the art may add various modifications to the embodiments above in terms of the detailed configurations, including the shapes, materials, and quantities, without deviating from the technical idea and the advantage of the invention.

The descriptions limiting the shapes and materials disclosed as above are therefore illustrative to make it easier to understand the invention and not restrictive. It is therefore understood that descriptions using members under the names, from which the limitations as to the shapes and the materials are removed, either partially or entirely, are included in the invention.

The entire disclosure of Japanese Patent Application No. 2005-48622, filed Feb. 24, 2005 is expressly incorporated by reference herein.

What is claimed is:

1. An image display device, comprising:

a total luminance value detection portion that detects a total luminance value in an entire image;

a level detection portion that detects whether the total luminance value exceeds a first specific level; and an incident light level lowering processing portion that performs processing to reduce an illumination light quantity from a light source that goes incident on a light modulation element in accordance with a function of the total luminance value when the level detection portion detects that the total luminance value exceeds the first specific level;

wherein the level detection portion is enabled to detect whether the total luminance value falls below a second specific level;

the first specific level is larger than the second specific level; and the incident light level lowering processing portion performs processing to reduce the illumination light quantity from the light source when the level detection portion detects that the, total luminance value falls below the second specific level.

2. The image display device according to claim 1, wherein:

the total luminance value detection portion detects the total luminance value from a sum of luminance values of all pixels within an entire display screen.

3. The image display device according to claim 1, further comprising:

an illumination light quantity adjudging device that adjusts the illumination light quantity from the light source.

4. The image display device according to claim 1, wherein:

the total luminance value detection portion detects the total luminance value from a direct current component in encoded display information.

5. An image display method, comprising:

detecting a total luminance value of an entire image;

detecting whether the total luminance value exceeds a first specific level;

reducing an illumination light quantity from a light source by performing light control in accordance with a function of the total luminance value when it is detected that the total luminance value exceeds the first specific level;

detecting whether the total luminance value falls below a second specific value, the first specific level is larger than the second specific level; and reducing the illumination light quantity from the light source when it is detected that the total luminance value falls below the second specific value.

6. A computer readable storage medium on which is recorded a program causing a computer inside an image display device to function as:

a total luminance value detection portion that detects a total luminance value in an entire image;

a level detection portion that detects whether the total luminance value exceeds a first specific level; and an incident light level lowering processing portion that performs processing to reduce an illumination light quantity from a light source that goes incident on a light modulation element in accordance with a function of the total luminance value when the level detection portion detects that the total luminance value exceeds the first specific level;

wherein the level detection portion is enabled to detect whether the total luminance value falls below a second specific level;

the first specific level is larger than the second specific level; and the incident light level lowering processing portion performs processing to reduce the illumination light quantity from the light source when the level detection portion detects that the total luminance value falls below the second specific level.

* * * * *

UNITED STATES PATENT AND TRADEMARK OFFICE

CERTIFICATE OF CORRECTION

PATENT NO. : 7,659,880 B2
APPLICATION NO. : 11/353939
DATED : February 9, 2010
INVENTOR(S) : Yasunaga Miyazawa It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 734 days.

Signed and Sealed this

Twenty-eighth Day of December, 2010

David J. Kappos

David J. Kappos
*Director of the United States Patent and Trademark Office*